US009555926B2

(12) United States Patent
Qiu

(10) Patent No.: US 9,555,926 B2
(45) Date of Patent: Jan. 31, 2017

(54) COLLAPSIBLE STORAGE BUCKET

(71) Applicant: JIANGSU ZHONGHENG PET ARTICLES JOINT-STOCK CO., LTD, Jiangsu (CN)

(72) Inventor: Bin Qiu, Jiangsu (CN)

(73) Assignee: Jiangsu Zhongheng Pet Supplies Co., Ltd., Jiangsu (CN)

( * ) Notice: Subject to any disclaimer, the term of this patent is extended or adjusted under 35 U.S.C. 154(b) by 0 days.

(21) Appl. No.: 14/298,141

(22) Filed: Jun. 6, 2014

(65) Prior Publication Data

US 2014/0361010 A1 Dec. 11, 2014

(30) Foreign Application Priority Data

Jun. 7, 2013 (CN) ..... 2013 2 0352419 U

(51) Int. Cl.

| | |
|---|---|
| ***B65D 1/40*** | (2006.01) |
| ***B65D 21/08*** | (2006.01) |
| ***B65D 1/02*** | (2006.01) |
| *B65D 43/02* | (2006.01) |

(52) U.S. Cl.

CPC ..... *B65D 21/086* (2013.01); *B65D 1/0292* (2013.01); *B65D 1/40* (2013.01); *B65D 43/02* (2013.01)

(58) Field of Classification Search

CPC ..... B65D 21/086; B65D 43/02; B65D 1/0292; B65D 1/40

USPC ..... 220/6, 9.2, 666, 720, 9, 2, 200

See application file for complete search history.

(56) References Cited

U.S. PATENT DOCUMENTS

| | | | | |
|---|---|---|---|---|
| 7,819,263 | B1 * | 10/2010 | DiCarlo-Nelson | 215/11.3 |
| 2003/0160055 | A1 * | 8/2003 | Stewart-Stand | 220/666 |
| 2010/0133281 | A1 * | 6/2010 | Wojcik et al. | 220/666 |
| 2010/0308004 | A1 * | 12/2010 | Yu et al. | 215/11.6 |
| 2011/0151069 | A1 * | 6/2011 | Harding | A61J 9/001 426/117 |
| 2011/0284547 | A1 * | 11/2011 | McElligott | B65D 21/086 220/495.03 |

* cited by examiner

*Primary Examiner* — Fenn Mathew
*Assistant Examiner* — Elizabeth Volz
(74) *Attorney, Agent, or Firm* — Hauptman Ham, LLP

(57) ABSTRACT

A collapsible storage bucket includes a chamber portion. The chamber portion further includes an opening. Additionally, the chamber portion is collapsible. The collapsible storage bucket further includes a bucket opening surround over the opening, where the bucket opening surround is detachable from the chamber portion. The collapsible storage bucket further includes a lid over the bucket opening surround, where the lid configured to cover an entirety of the opening. Additionally, the lid is detachable from the bucket opening surround.

11 Claims, 3 Drawing Sheets

COLLAPSIBLE STORAGE BUCKET

CROSS REFERENCE TO RELATED APPLICATION

The present application is based on, and claims priority from, Chinese Application Number 201320352419.4, filed Jun. 7, 2013, the disclosure of which is incorporated herein in its entirety.

TECHNICAL FIELD

The present disclosure relates generally to a pet product and, specifically, a collapsible storage bucket used for storing pet food.

BACKGROUND

With the development of society and the improvement of living standards, people are constantly in pursuit of the spiritual life, while enjoying the material life. Consequently, having pets is gradually becoming a popular custom. Since pets are occupying a higher position in people's lives, people are demanding an ever higher quality of life for their pets. Because more and more people are feeding their pets with pet food, the storage and transportation of the pet food has been problematic. While conventional storage buckets have appeared in the market, most of these buckets are made of a ceramic or a metal material. They are designed as a single unit which cannot be expanded, collapsed, or dismantled. Furthermore, these buckets are heavy, expensive for transportation, easily susceptible to damage, and take up large amounts of storage space. In response to these problems, there have been some improvements in the design of these buckets; however, none of the improvements are able to entirely remedy the above problems in conventional storage buckets.

BRIEF DESCRIPTION OF THE DRAWINGS

The present disclosure will be further described in conjunction with drawings and embodiments. Aspects of the present disclosure are to be understood from the following detailed description when read with the accompanying figures which are incorporated herein by reference.

DETAILED DESCRIPTION

Figure 1:
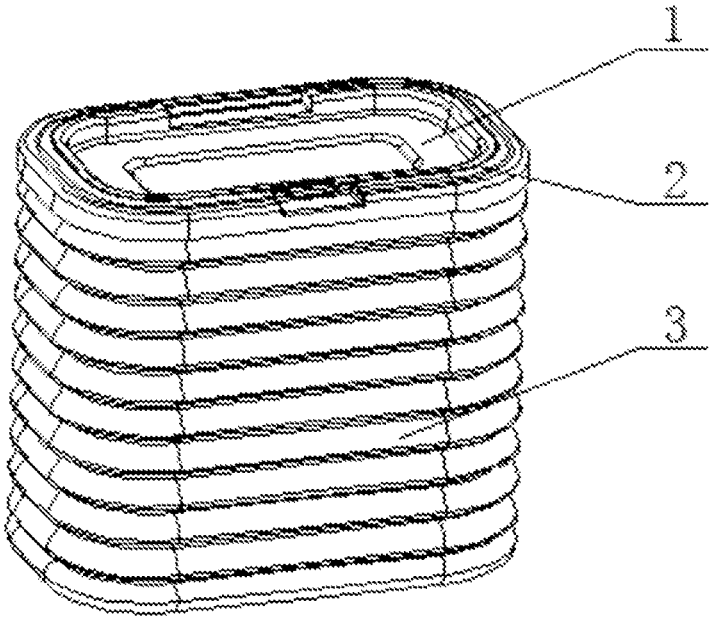
FIG. 1 is a schematic perspective view of a collapsible storage bucket in accordance with an embodiment.
Figure 2:
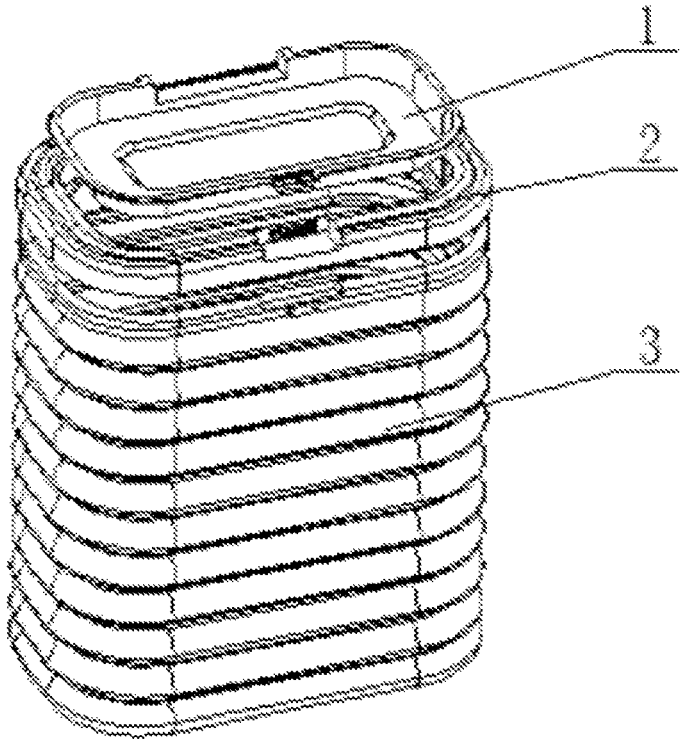
FIG. 2 is a schematic perspective view of a collapsible storage bucket with a lid, a bucket opening surround, and a chamber portion in accordance with an embodiment.
Figure 3:
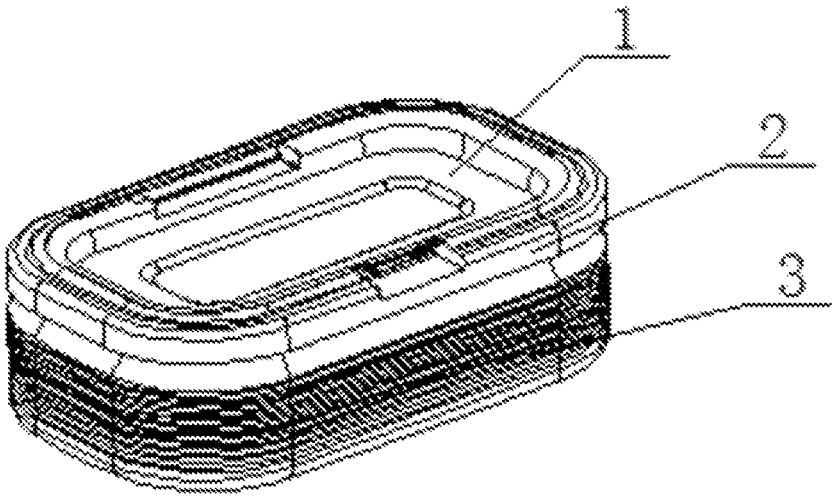
FIG. 3 is a schematic perspective view of a collapsible storage bucket with a chamber portion in a collapsed state in accordance with an embodiment.

An embodiment, as described in connection with FIGS. 1-3, is a collapsible storage bucket 100. The collapsible storage bucket 100 includes a chamber portion 200, wherein the chamber portion includes an opening. Additionally, the collapsible storage bucket 100 includes a bucket opening surround 300 and a lid 400. The bucket opening surround 300 is placed over the opening of the chamber portion 200. The lid 400 is placed over the bucket opening surround 300 to cover the opening of the chamber portion 200.

Chamber portion 200, which is an enclosure that is collapsible, is made from a blow-molded material. The chamber portion 200 includes the opening, and a base 250. The chamber portion 200 has a vertical height perpendicular to the base 250. In some embodiments, the chamber portion 200 has sidewalls that are shaped like sidewalls of a spring. In some embodiments, the chamber portion 200 has sidewalls that are accordion pleated. In some embodiments, the chamber portion 200 has accordion pleats that are perpendicular to the vertical height. Several advantages are provided by one or more embodiments of the chamber portion including the following features: the chamber portion 200 is sturdy, durable, and easy to clean; the height is freely adjustable according to the amount of food stored; and the chamber portion is compressed to its smallest size, thereby reducing transportation costs, and making the storage more efficient, as illustrated in FIG. 3.

Bucket opening surround 300 is placed over the opening of chamber portion 200. In some embodiments, the bucket opening surround 300 is separate and detachable from the chamber portion 200.

Lid 400 is placed over bucket opening surround 300 to cover the opening of chamber portion 200. The lid 400 has a size which is commensurate with the bucket opening surround 300 such that the lid covers the entire opening. In some embodiments, the lid 400 is separate and detachable from the chamber portion 200 to form different entities. In some embodiments, the lid 400 is attached to the chamber portion 200. In some embodiments, the lid 400 is made from a blow-molded material. Several advantages are provided by one or more embodiments of the lid 400 including the following features: ease of cleaning and assembly when the lid and the chamber portion 200 require cleaning.

In order to overcome the aforementioned shortcomings, one or more objects of one or more embodiments of the present disclosure are to provide a collapsible storage bucket. The collapsible storage bucket 100 is capable of being extended and collapsed. Thus, the collapsible storage bucket 100 is lightweight, compact, and efficient for transportation and storage. Additionally, the collapsible storage bucket 100 has a rational structure which is also aesthetically appealing in some embodiments.

In an aspect of one or more embodiments, a collapsible storage bucket includes a chamber portion that is collapsible, wherein the chamber portion includes an opening. Additionally, the collapsible storage bucket includes a bucket opening surround and a lid. The bucket opening surround is placed over the opening of the chamber portion. The lid is placed over the bucket opening surround to cover the opening of the chamber portion.

The chamber portion, which is collapsible, is made from a blow-molded material. The chamber portion includes the opening, and a base. The chamber portion has a vertical height perpendicular to the base. In some embodiments, the chamber portion has sidewalls that are shaped like sidewalls of a spring. In some embodiments, the chamber portion has sidewalls that are accordion pleated. In some embodiments, the chamber portion has accordion pleats that are perpendicular to the vertical height. In some embodiments, the chamber portion is used to store pet food. Several advantages are provided by one or more embodiments of the chamber portion including the following features: the chamber portion is sturdy, durable, and easy to clean; the height is freely adjusted according to the amount of food stored; and the chamber portion is compressed to its smallest size, thereby reducing transportation costs, and making the storage more efficient.

The bucket opening surround is placed over the opening of the chamber portion. In some embodiments, the bucket opening surround is separate and detachable from the chamber portion.

The lid is placed over the bucket opening surround to cover the opening of the chamber portion. In some embodiments, the lid is separate and detachable from the chamber portion to form different entities. In some embodiments, the lid is attached to the bucket opening surround. Several advantages are provided by one or more embodiments of the lid including the following features: ease of cleaning and assembly when the lid and the chamber portion require cleaning.

Several advantages are provided by one or more embodiments including the following features: the collapsible storage bucket has potential to be efficient with storage, while having a rational structure which is also aesthetically appealing in some embodiments; the chamber portion has a collapsible structure; the chamber portion is sturdy and durable; the collapsible storage bucket facilitates ease of use, storage, and transport.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The invention claimed is:

1. A collapsible storage bucket comprising:

a chamber portion comprising an opening, wherein the chamber portion has sidewalls which are collapsible;

a bucket opening surround over the opening, wherein the bucket opening surround is detachable from the chamber portion; and a lid over the bucket opening surround, the lid configured to cover an entirety of the opening, wherein the lid is detachable from the bucket opening surround, wherein in a collapsed state, the collapsible sidewalls of the chamber portion are collapsed and an outside edge of the chamber portion is exposed outside without being covered by the bucket opening surround and the lid, the lid includes a center portion recessed from an upper peripheral edge of the lid, and the upper peripheral edge of the lid is configured to be directly laid over the bucket opening surround, the lid has a cavity open away from the chamber portion when the lid is attached to the bucket opening surround, and the center portion of the lid includes a central region defining a bottom of the cavity and further recessed from a lower peripheral edge of the lid.

2. The collapsible storage bucket of claim 1, wherein the sidewalls of the chamber portion are shaped like sidewalls of a spring.

3. The collapsible storage bucket of claim 1, wherein the lid comprises a blow-molded material.

4. The collapsible storage bucket of claim 1, wherein the chamber portion comprises a blow-molded material.

5. The collapsible storage bucket of claim 1, wherein the bucket opening surround comprises a blow-molded material.

6. The collapsible storage bucket of claim 1, wherein the chamber portion is an enclosure.

7. The collapsible storage bucket of claim 1, wherein the chamber portion is configured for storing food.

8. The collapsible storage bucket of claim 1, wherein the sidewalls of the chamber portion are accordion pleated.

9. The collapsible storage bucket of claim 1, wherein the chamber portion comprises a plurality of accordion pleats, wherein each of the plurality of accordion pleats are perpendicular to a vertical height of the chamber portion.

10. The collapsible storage bucket of claim 1, wherein the central region is substantially flat.

11. The collapsible storage bucket of claim 10, wherein the lid further includes a sidewall having upper and lower edges defined by the upper and lower peripheral edges of the lid, respectively, and the central region of the center portion is lower than the lower edge of the side wall.

* * * * *